US010220916B2

(12) United States Patent
Hooper et al.

(10) Patent No.: US 10,220,916 B2
(45) Date of Patent: Mar. 5, 2019

(54) OPEN WATER TRANSPORT SYSTEM

(71) Applicant: SPAWAR Systems Center Pacific, San Diego, CA (US)

(72) Inventors: Ralph D. Hooper, Lemon Grove, CA (US); William A. Chambers, Jamul, CA (US); Jeffery T. Gilchrist, Cardiff, CA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/623,152

(22) Filed: Jun. 14, 2017

(65) Prior Publication Data

US 2018/0362117 A1 Dec. 20, 2018

(51) Int. Cl.

| | |
|---|---|
| ***B63B 1/12*** | (2006.01) |
| ***B63B 25/00*** | (2006.01) |
| ***B63B 27/00*** | (2006.01) |
| ***B63B 27/12*** | (2006.01) |
| ***B63B 3/48*** | (2006.01) |
| ***B63B 7/08*** | (2006.01) |
| ***B63B 21/56*** | (2006.01) |
| *B63G 8/00* | (2006.01) |

(52) U.S. Cl.

CPC ..... *B63B 1/121* (2013.01); *B63B 3/48* (2013.01); *B63B 7/082* (2013.01); *B63B 21/56* (2013.01); *B63B 25/002* (2013.01); *B63B 2001/123* (2013.01); *B63B 2211/02* (2013.01); *B63G 2008/002* (2013.01); *B63G 2008/005* (2013.01); *B63G 2008/008* (2013.01)

(58) Field of Classification Search

CPC ..... B63B 1/121; B63B 7/082; B63B 3/48; B63B 25/002; B63B 21/56; B63B 2211/02; B63B 2001/123; B63G 2008/002; B63G 2008/005; B63G 2008/008

USPC ..... 114/61.1, 61.14

See application file for complete search history.

(56) References Cited

U.S. PATENT DOCUMENTS

| | | | | |
|---|---|---|---|---|
| 6,099,232 | A | 8/2000 | Dixon | |
| 6,318,931 | B1 * | 11/2001 | Khachaturian | B63B 9/065 405/204 |
| 6,779,475 | B1 | 8/2004 | Crane | |
| 6,840,188 | B1 * | 1/2005 | Witbeck | B63B 27/36 114/258 |
| 7,350,475 | B2 | 4/2008 | Borgwarth | |
| 7,562,633 | B2 * | 7/2009 | Conti | B63B 1/14 114/61.1 |
| 7,699,015 | B1 | 4/2010 | Said | |

(Continued)

*Primary Examiner* — Anthony D Wiest

(74) *Attorney, Agent, or Firm* — SPAWAR Systems Center Pacific; Kyle Eppele; Elliott Deaderick

(57) ABSTRACT

An open water transport system for payloads and a method for transporting payloads. The system includes two sponsons substantially parallel to the other. The sponsons are spaced apart from each other and extending in a forward direction. A deck plate module is detachably mounted on top of each sponson. A superstructure may be detachably mounted to the deck plate modules. The superstructure may bear a weight of one or more payloads. The carriage assembly couples to the payload(s). The carriage assembly has an adjustment mechanism that permits an operator to redistribute the weight of a payload. The open water transport system is towed by another vehicle.

17 Claims, 8 Drawing Sheets

(56) References Cited

U.S. PATENT DOCUMENTS

| | | | | |
|---|---|---|---|---|
| 7,712,429 | B1 | 5/2010 | Gibson | |
| 7,900,547 | B2 * | 3/2011 | Atmur | F41F 3/04 89/1.815 |
| 8,640,640 | B2 * | 2/2014 | Conti | B63B 1/121 114/61.15 |
| 8,813,669 | B2 | 8/2014 | Race | |
| 8,944,866 | B2 | 2/2015 | Hine | |
| 9,067,648 | B2 | 6/2015 | Carcone | |
| 9,291,438 | B2 | 3/2016 | Item | |
| 9,862,464 | B2 * | 1/2018 | Schmidt | B63B 29/02 |
| 2006/0060124 | A1 | 3/2006 | Dicampli | |
| 2006/0191457 | A1 | 8/2006 | Murphy | |

* cited by examiner

OPEN WATER TRANSPORT SYSTEM

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil. Reference Navy Case No. 104,244.

BACKGROUND OF THE INVENTION

Field of Invention

This disclosure relates to transportation systems, and more particularly, to water transportation systems.

Description of Related Art

Water transport is useful for launching and recovering various payloads, including unmanned underwater vehicles (UUVs) and remotely operated vehicles (ROVs). For example, UUVs and ROVs may need to be transported over water so that the UUVs/ROVs may be used to collect oceanographic data that aids in better understanding the ocean. Also by way of example, telecommunications companies use UUVs/ROVs to search for cables. As yet another example, the oil and gas industry uses UUVs/ROVs for visual inspection, cleaning and adjusting valves and chokes. As still yet another example, military applications use UUVs/ROVs for mine countermeasures.

As the UUV/ROV itself is essentially a fixed constraint, the auxiliary mission support equipment becomes the focus of expeditionary-scaling. The equipment necessary to transport, launch, and recover the UUVs/ROVs in the shallow water environment must be forward-deployable with reduced weight, volume and complexity, in order to meet emerging expeditionary requirements. Sustainment requirements of this expeditionary capability may also be proportionally reduced as the system complexity drops.

Special purpose rigid inflatable boats (RIBs) have been used to launch and recover UUVs/ROVs, each of which may weigh as much as—or more than—one thousand pounds (1,000 lbs). However such RIBs are large and expensive. Such RIBs may also be difficult to move around, particularly when not in use, due to their large size and their lack of ability to be collapsed into smaller units. In addition, such RIBs may be transportable only on certain aircraft due to size and weight constraints.

There is a need for an open water transport system that is less expensive and easier to transport, including when not in use.

There is further a need for an open water transport system that aids in transporting, launching, and recovering UUVs/ROVs in the shallow water environment, and that is forward-deployable with reduced weight, volume and complexity.

BRIEF SUMMARY OF INVENTION

The present disclosure addresses the needs noted above by providing an open water transport system. The open water transport system includes a plurality of sponsons substantially parallel to each other. The open water transport system further includes a plurality of deck plate modules detachably mounted on top of a sponson. The open water transport system further includes a plurality of superstructures detachably mounted to the deck plate modules to bear a weight of one or more payload.

The open water transport system still further includes a plurality one of carriage assemblies that allow redistribution of payloads to couple the open water transport system to a payload.

These, as well as other objects, features and benefits will now become clear from a review of the following detailed description, the illustrative embodiments, and the accompanying drawings.

BRIEF DESCRIPTION OF DRAWINGS

The accompanying drawings, which are incorporated in and form a part of the specification, illustrate example embodiments and, together with the description, serve to explain the principles of the open water transport system and method of transporting cargo in open water. In the drawings.

DETAILED DESCRIPTION OF THE INVENTION

The present disclosure is directed to an open water transport system, and a method for transporting payloads in open water. The open water transport system may be the primary means of moving UUVs and/or ROVs across water from a first location to a second location. The open water transport system may be a surface watercraft towed behind an inflatable boat or other powered vehicle. Any inflatable boat or other vehicle with the horsepower and tow point ratings can tow the open water transport system. The open water transport system may be adapted to transport just about any payload, including UUVs and ROVs. In this manner, the open water transport system acts as something of a pick-up truck in open water.

Figure 1A:
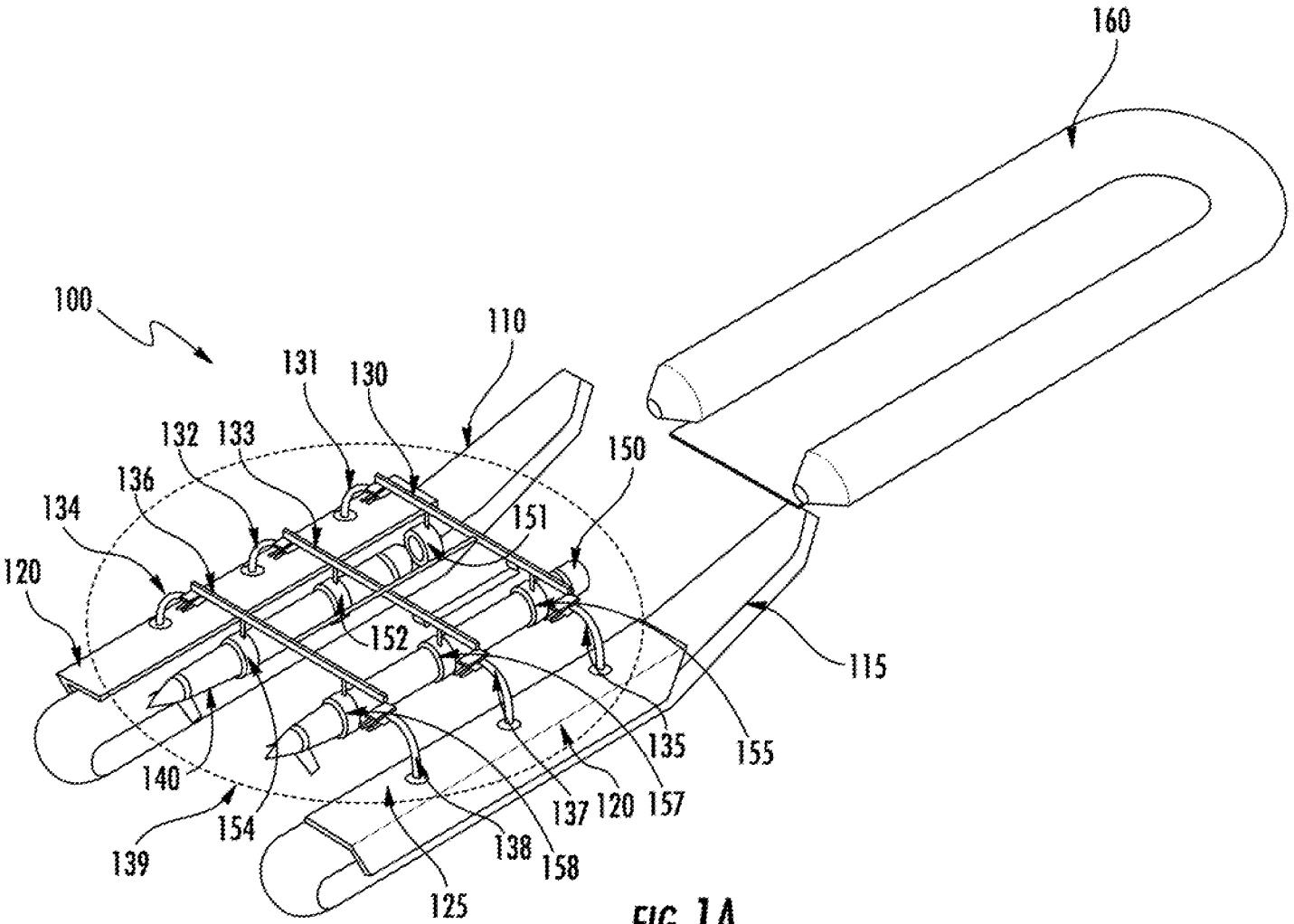
FIG. 1A illustrates a perspective view of an open water transport system being towed by an inflatable boat in accordance with one embodiment of the present disclosure.

FIG. 1A illustrates a perspective view of an open water transport system that can be towed by an inflatable boat in accordance with one embodiment of the present disclosure. As shown in FIG. 1A, open water transport system 100 includes sponsons 110, 115 and deck plate modules 120, 125. Sponsons 110, 115 may be inflatable, and formed of polyurethane or rubber fabric or other suitable fabric. One of ordinary skill in the art may appreciate that a number of suitable fabrics may be used for sponsons 110, 115.

Sponsons 110, 115 may assist in providing buoyancy and at sea stability to the open water transport system 100. Sponsons 110, 115 may be tubular as shown, and have a portion that is filled with air in order to aid in flotation. It may be desirable for the fabric of the sponsons 110, 115 to be substantially waterproof. Having two sponsons, e.g., 110, 115, may be desirable over a single sponson 110, since the two sponsons 110, 115 could provide sufficient buoyancy to keep the open water transport system 100 afloat, even when the open water transport system 100 is weighed down with one or more payloads, e.g., one or more UUVs or ROVs. Sponsons 110, 115 may be designed to minimize drag when the open water transport system 100 is towed.

Sponsons 110, 115 may be substantially parallel to each other when the open water transport system 100 is assembled. The sponsons 110, 115 may be spaced apart and extend in a forward direction. Sponson 110 may be on the port side of the open water transport system 100, while sponson 115 may be on the starboard side of the open water transport system 100.

Deck plate modules 120, 125 may be disposed on top of the sponsons 110, 115, respectively. For purposes of the present disclosure, one object may be considered on top of, or above, another when the first object is mostly in a higher elevation than the other object in relation to sea level or ground. The deck plate modules 120, 125 may be substantially parallel to each other. The deck plate modules 120, 125 may be spaced apart and extend in a forward direction. As shown in FIG. 1, the forward direction is the direction in which the open water transport system 100 would be towed, when hooked up to a towing vehicle. Each of deck plate modules 120, 125 is detachably coupled to each sponson 110, 115, respectively.

Cross braces 130, 133 and 136 may include end pieces 131, 132, 134, 135, 137, 138 that permit a connection between the port and starboard sides of the open water transport system 100. For example, cross brace 130 may be connected to deck plate module 120 on the port side via end piece 131, and on the starboard side via end piece 135. Similarly, cross brace 133 may be connected to deck plate module 120 on the port side via end piece 132, and on the starboard side via end piece 137. Cross brace 136 may be connected to deck plate module 120 on the port side via end piece 134, and on the starboard side via end piece 138.

Cross braces 130, 133, 136 may form part of a larger superstructure 139 designed to carry one or more payloads, e.g., UUVs or ROVs. Cross braces 130, 133, 136 may be rigid metal tubing welded together made of high strength material, e.g., high strength stainless steel. Titanium or aluminum may also be used, depending on the strength needed. The collective superstructure 139, including cross braces 130, 133, 136, may be capable of carrying significant weight, e.g., about two thousand pounds (2,000 lbs), which is what two (2) UUVs/ROVs might weigh. Superstructure 139 may be capable of carrying a single UUV/ROV in the middle of the space between sponson 110 and sponson 115, and away from the legs or other area of superstructure 139 that hold it up and support that weight.

The superstructure 139 may be composed of high strength materials such as stainless steel in order to enable the weight capacity. It may also be desirable for the material for superstructure 139 to be corrosion-resistant since the open water transport system 100 is designed to be a water vessel. To these ends, the lightweight, high weight capacity, corrosion-resistant material used may be, e.g., 17-7 precipitation hardened lightweight strong stainless steel alloy. The superstructure 139 itself may weigh as little as one hundred eighty (180) pounds. The open water transport system 100 may weigh, e.g., a total of seven hundred fifty (750) pounds.

Superstructure 139 may be bolted to deck plate modules 120, 125. The combined superstructure 139 and deck plate modules 120, 125 may be bolted to sponsons 110, 115. In lieu of bolts, other suitable detachable coupling or attachment means may be used.

A UUV, e.g., UUV 140 may be transported via the clamps 151, 152, 154. UUV 150 may be transported via clamps 155, 157, 158. UUV 140 and UUV 150 may represent different types and shapes of UUVs. Inflatable boat 160 may tow open water transport system 100. Inflatable boat 160 may be powered by a motor and rated to tow a device having the weight of the open water transport system 100 and its payload(s). The payloads here are UUV 140 and UUV 150.

The open water transport system 100 may provide adjustable, padded, stowage bunks to accommodate the aforementioned UUV length and weight variables for two UUVs, e.g., UUV 140, 150. The open water transport system 100 may provide securing hardware (in addition to bolts) in order to restrain the UUVs 140, 150 in the stowed position. The open water transport system 100 may provide all of the necessary range-of-motion (articulations and translations) necessary to launch, recover and stow two UUVs/ROVs sequentially. The open water transport system 100 may engage the UUVs 140, 150 on a bail located on either of UUV 140 or UUV 150, and vertically-aligned with the longitudinal center-of-gravity of either of UUV 140 or UUV 150. The open water transport system 100 may provide operational release and recover from the bail. Clamp assemblies 151, 152, 154, 155, 157, 158 may form a part of the superstructure 139. Clamp assemblies 151, 152, 154, 155, 157, 158 may be changed out for differently sized clamp assemblies in order to facilitate the clamping onto various types and sizes of UUVs/ROVs. The superstructure 139, including clamp assemblies 151, 152, 154, 155, 157 158 may permit the open water transport system 100 to carry one UUV/ROV, e.g., UUV 140 or UUV 150, or two UUVs/ROVs, e. g., UUV 140 and UUV 150. The UUVs 140, 150 may be held underneath the superstructure 139 as shown in FIG. 1A.

The open water transport system 100 may be modular such that each module is separable from each other module. In addition, similar pieces of the open water transport system 100 can be interchangeable with each other. For example, each of sponsons 110, 115 may be used on either the port side or the starboard side. Likewise, each of deck plate modules 120, 125 may be used on either the port side or the starboard side.

Figure 1B:
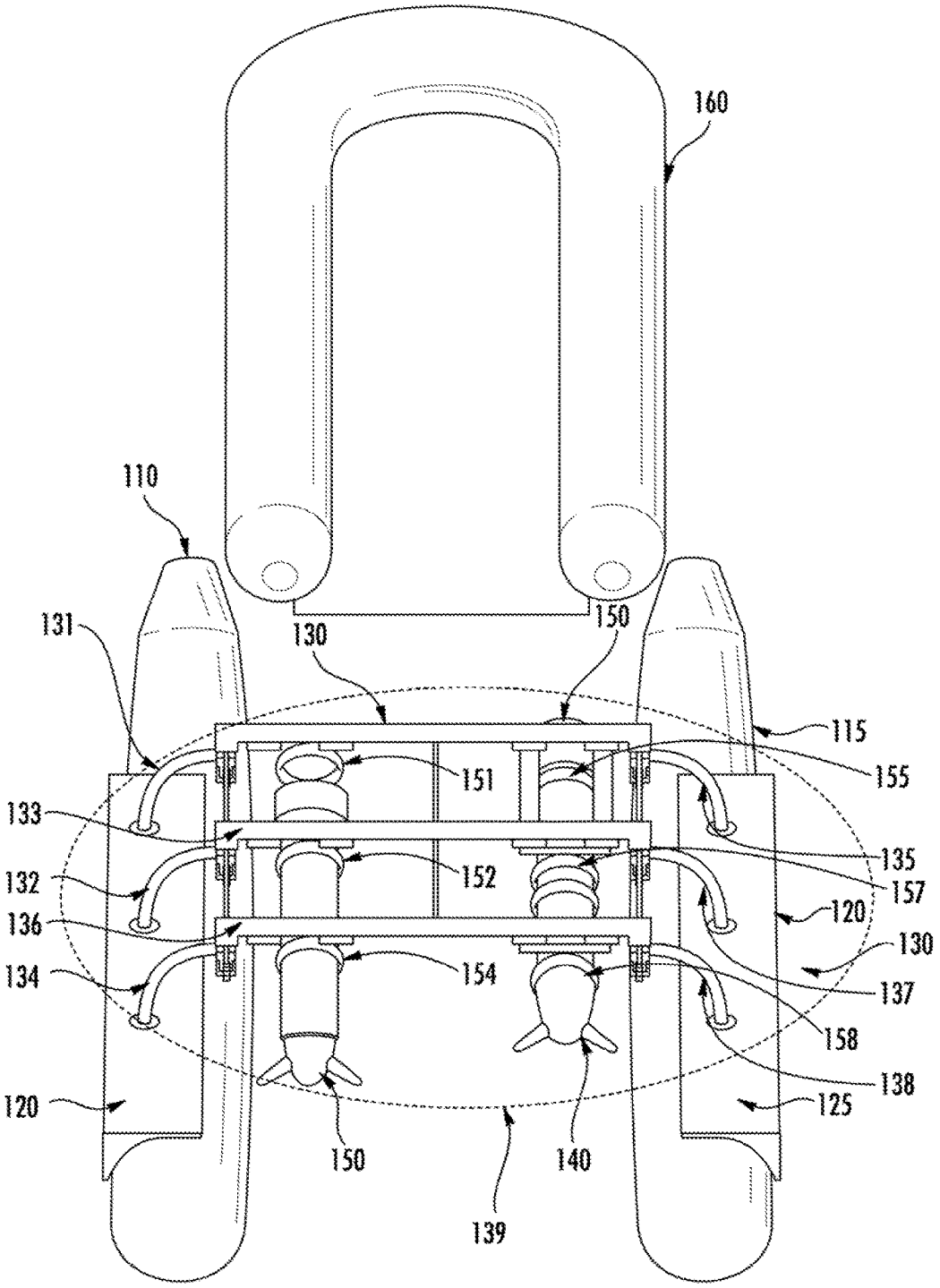
FIG. 1B illustrates a top view of an open water transport system being towed by an inflatable boat in accordance with one embodiment of the present disclosure.

FIG. 1B illustrates a top view of an open water transport system being towed by the inflatable boat. FIG. 1B offers another view of the two UUVs 140, 150 being transported as payloads. UUV 140 may be transported via clamps 151, 152, 154. UUV 150 may be transported via clamps 155, 157, 158.

Figure 2:
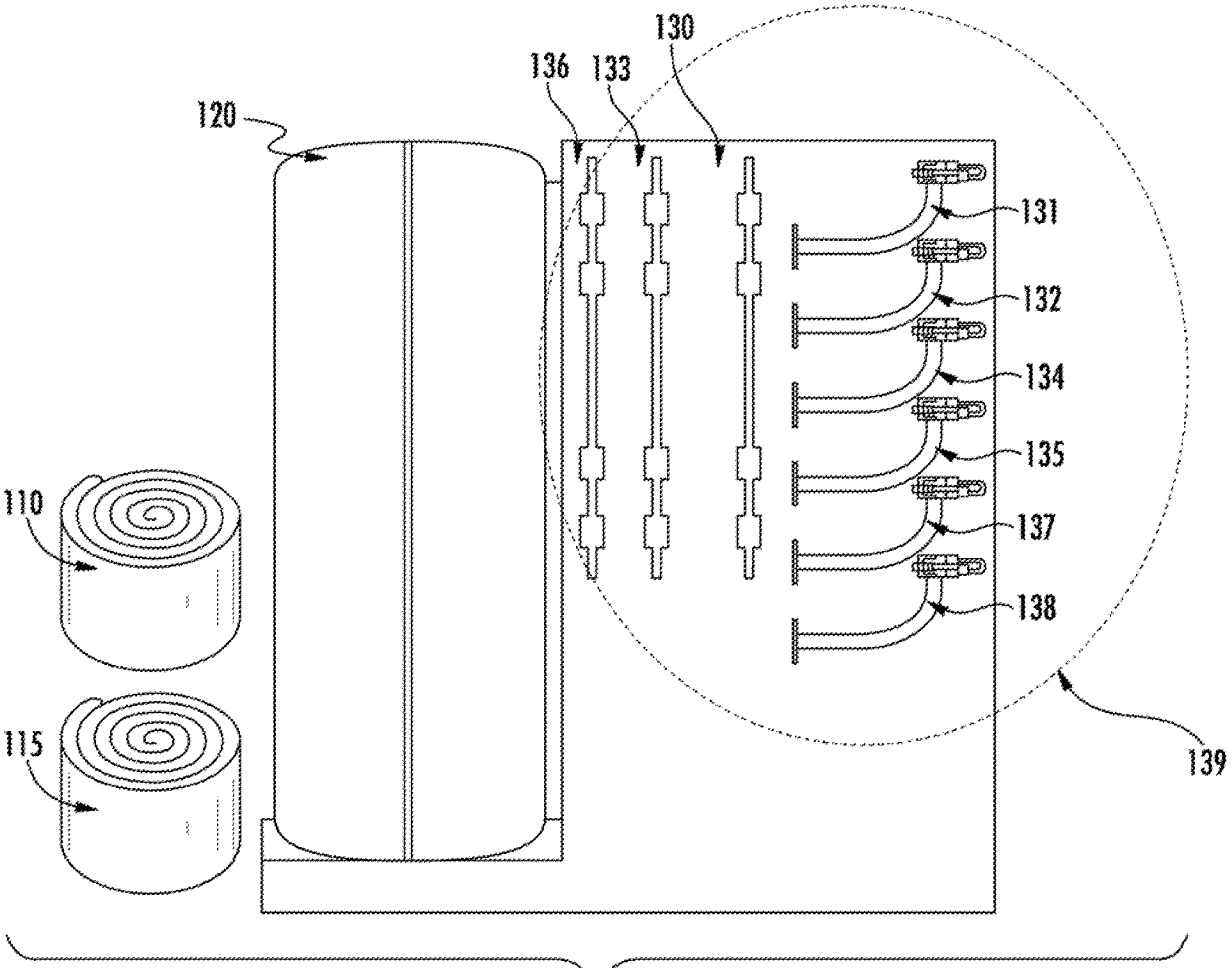
FIG. 2 illustrates the open water transport system of FIGS. 1A and 1B after it has been dismantled and palletized for shipment in accordance with one embodiment of the present disclosure.

FIG. 2 illustrates portions of the open water transport system of FIGS. 1A and 1B after the system has been dismantled, or separated, and palletized for shipment in accordance with one embodiment of the present disclosure.

As shown, each of cross braces 130, 133 and 136 has been separated from its respective end pieces 131, 135, 132, 137, 134, 138. Deck plate module 120 is shown stacked in front of a second deck plate module (not visible because of the stacked configuration).

Figure 3:
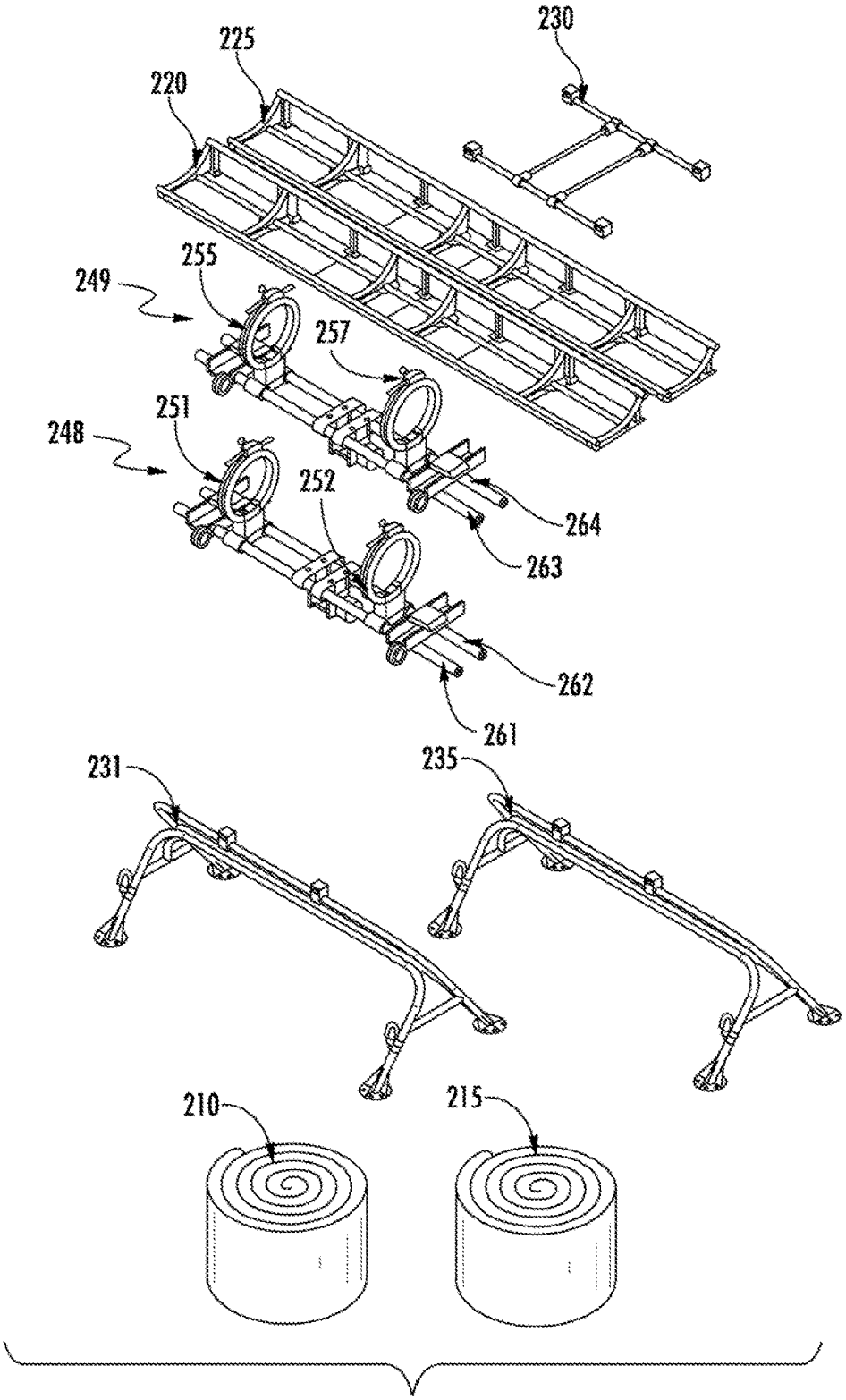
FIG. 3 illustrates various elements of an open water transport system in accordance with another embodiment of the present disclosure.

Referring now to FIG. 3, illustrated are various elements of an open water transport system in accordance with another embodiment of the present disclosure. As shown in FIG. 3, the dismantled open water transport system includes two deflated sponsons 210, 215. The dismantled open water transport system also includes two deck plate modules 220, 225, which are shown in an upside down position in the present illustration. The cross brace 230 which may connect first superstructure 231 to second superstructure 235 is also shown.

A first carriage assembly 248 is shown next to a second carriage assembly 249. First carriage assembly 248 includes clamp assemblies 251, 252. Second carriage assembly includes clamp assemblies 255, 257. First carriage assembly 248 includes two rails 261, 262, designed to slideably mount first carriage assembly 248 to first superstructure 231. Second carriage assembly 249 also includes two rails 263, 264 designed to slideably mount second carriage assembly 249 to the second superstructure 235. The slideable attachment occurs when wheels 271, 272, 273, 274, 275, 276, 277, 278 slide onto the rails of superstructures 231, 235. As can be appreciated by one of ordinary skill in the art, the slideable attachment between superstructures 231, 235 and carriage assemblies 248, 249 may occur through various mechanisms. For example, additional wheels or other rolling mechanisms may be mounted each of superstructures 231, 235 so that the wheels roll in a horizontal direction in order to facilitate the slideable attachment of the superstructures 231, 235 to carriage assemblies 248, 249. The wheels may be mounted in front of superstructures 231, 235, or on top of superstructures 231, 235, or in any other position deemed suitable to facilitate slideable attachment of the superstructures 231, 235 to carriage assemblies 248, 249.

Figure 4A:
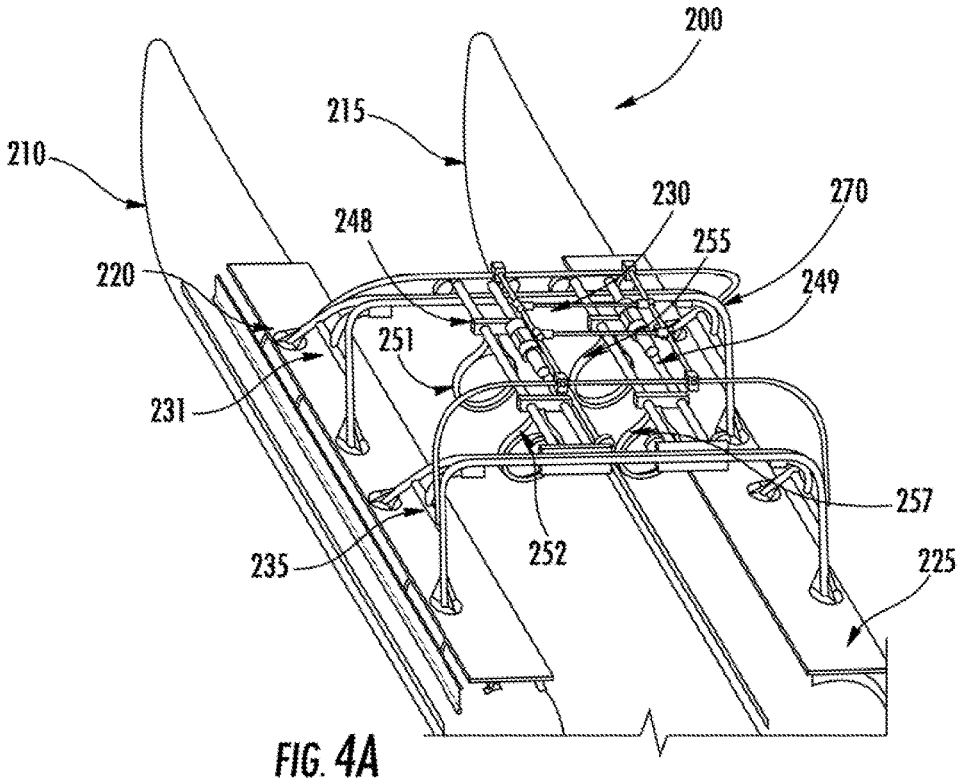
FIGS. 4A and 4B illustrate the open water transport system elements of FIG. 3 in an assembled state in accordance with one embodiment of the present disclosure.
Figure 4B:
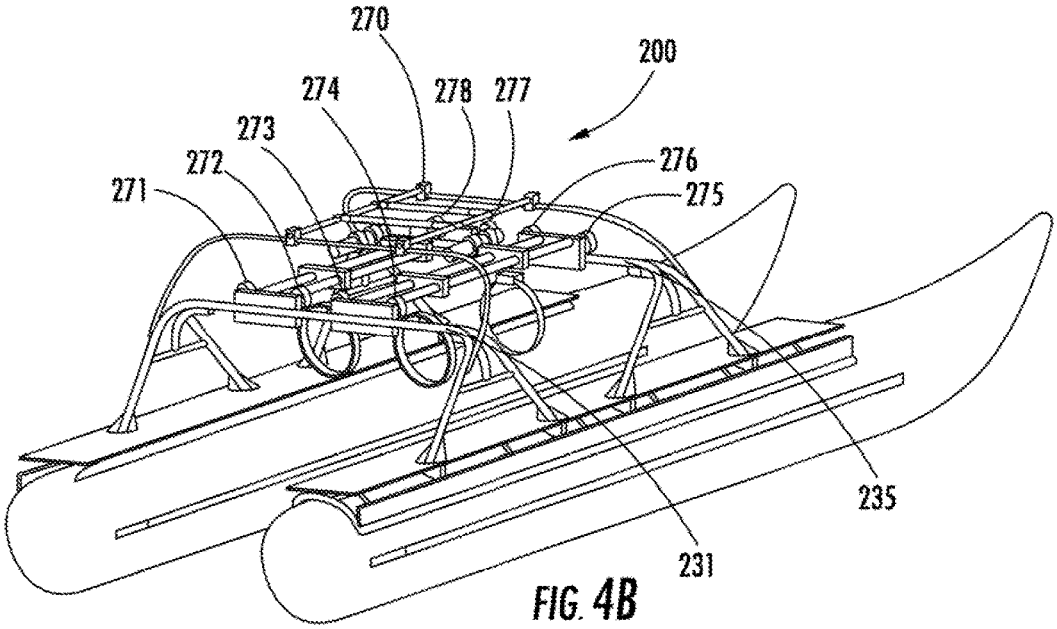

Once the open water transport system has been received by an end user, it may be assembled. Referring now to FIGS. 4A and 4B, illustrated are the open water transport system elements of FIG. 3 in an assembled state in accordance with one embodiment of the present disclosure.

As shown in FIGS. 4A and 4B, the assembled open water transport system 200 includes two inflated sponsons 210, 215. The two sponsons 210, 215 are substantially parallel to each other. The two sponsons 210, 215 are spaced apart. The two sponsons 210, 215 extend in a forward direction. For purposes of the present disclosure, the phrase "forward direction" means the direction in which open water transport system is designed to travel or be towed. It should be appreciated by one of ordinary skill in the art that a number of different sponsons may be suitable for the present open water transport system. For example, in lieu of inflatable sponsons, rigid metal sponsons could be used as a hull and would not need to be inflated.

The two deck plate modules 220, 225, are substantially parallel to one another. The two deck plate modules 220, 225 are spaced apart. The spacing of the deck plate modules may be dependent on the spacing of the sponsons 210, 215, onto the tops of which the deck plate modules may be detachably mounted with bolts or other attachment means. For purposes of the present disclosure, one object may be considered mounted on top of another object when the first object is mounted onto the second object at a location on the second object that is at substantially the highest elevation in relation to sea level or ground when the open water system 200 is assembled. Like the sponsons 210, 215, the deck plate modules 220, 225 also extend in the forward direction.

The cross brace 230 may connect first superstructure 231 to second superstructure 235. The first superstructure 231 may be detachably mounted on top of the deck plate modules 220, 225. The first superstructure may be positioned in front of the second superstructure 235. The second superstructure 235 may be detachably mounted on top of deck plate modules 220, 225 via bolts or other detachable coupling means. In the present illustration, second superstructure 235 is in an aft position relative to the first superstructure 231.

Together, the cross brace 230 and the two superstructures 231, 235 are configured to bear a weight of one or more UUVs/ROVs or other payload(s). These payloads may be present when the open water transport system 200 is in use.

A first carriage assembly 248 is shown next to a second carriage assembly 249. First carriage assembly 248 includes clamp assemblies 251, 252. Second carriage assembly 249 includes clamp assemblies 255, 257. Each of clamp assemblies 251, 252, 255, 257 may act as a coupling device, and may couple to a UUV/ROV by closing around the outer circumference of the UUV/ROV, thus clampably coupling the clamp assemblies 251, 252, 255, 257 of the open water transport system 200 to the UUV/ROV. The diameter of the clamps in the clamp assemblies 251, 252, 255, 257 may be sufficiently large to accommodate the circumference of a UUV/ROV. For example, the inside diameter of the clamp assemblies 251, 252, 255, 257 may be as small as four inches (4") or as large as two feet (2'). The size of the clamp assemblies 251, 252, 255, 257 would be dependent on the size of the UUVs/ROVs being transported as different UUVs/ROVs would have different diameters. The fingers of the clamp may also be different for different diameters. If the UUV/ROV were not cylindrical in nature, then the clamp assemblies 251, 252, 255, 257 could be modified in order to accommodate the shape of the UUV/ROV, as can be appreciated by one of ordinary skill in the art.

The UUV/ROV (not shown in FIGS. 4A and 4B) could attach to top or bottom of superstructures 231, 235. For purposes of the present disclosure, one object may be considered on the bottom of, under, or underneath another when the first object is mostly at a lower elevation than the other object in relation to sea level or ground. Where the UUV is relatively heavy, it may be desirable to attach it underneath the superstructures 231, 235. It may also be desirable to place smaller UUVs on top of the superstructures 231, 235. In some instances, the superstructures 231, 235 may hold, on their tops or bottoms, communication devices that communicate with an ROV, which operates from a base station. In some cases, an ROV may attach to superstructure 231, 235 by more simplistic means than clamp assemblies 251, 252, 255, 257. For example, the UUV/ROV may simply be strapped down, particularly if they are small in size. In some cases, bolts may hold the UUV/ROV in place.

The carriage assemblies 248, 249 may slideably mount to the superstructures 231, 235, respectively. First carriage assembly 248 includes two rails 261, 262, designed to slideably mount first carriage assembly 248 to first superstructure 231. Second carriage assembly 249 also includes two rails 263, 264 designed to slideably mount second carriage assembly 249 to the second superstructure 235. As an alternative to the cross brace 230 detachably coupling the first superstructure 231 to the second superstructure, a second story structure 270 may detachably couple the first superstructure 231 to the second superstructure 235. The second story structure 270 may be mounted on top of superstructures 231, 235 and may be used to hold an additional payload (not shown in FIGS. 4A and 4B), and the second story structure may be configured to bear a weight of the additional payload. Therefore, open water transport system 200 may hold at least three payloads. Cross brace 230 may detachably couple to the second story structure 270.

The carriage assemblies 248, 249 may be adjustable so that one UUV/ROV may be moved closer to either of superstructure 231 and superstructure 235 when a UUV/ROV is present, allowing the user to redistribute the weight of the payload, whether it is one UUV/ROV or two UUVs/ROVs. The carriage assemblies 248, 249 may permit the user to cause the UUV/ROV to traverse from port to starboard and vice versa. The carriage assemblies 248, 249 may use wheels 271, 272, 273, 274, 275, 276, 277, 278 that roll on top of the superstructures 231, 235. The carriage assemblies 248, 249 may have a spring loaded pin (not shown in FIGS. 4A and 4B) that positions the carriage to set locations onto the superstructures 231, 235. The user may pull the pin on either of carriage assemblies 248, 249 and move the carriage assemblies 248, 249 into the desired location. Once either of carriage assemblies 248, 249 is in the desired location, then the user may release the pin. The weight of the payload(s) may be redistributed for a number of reasons, including for the reason of creating balance for the open water transport system 200. If the weight were not distributed in a reasonable manner, the open water transport system 200 may tilt or be lopsided.

In order to provide for weight redistribution, the carriage assemblies 248, 249 may move from port to starboard or vice versa. If the user has only one UUV/ROV for transport, the user could lock the UUV/ROV in the middle and the weight of the UUV/ROV may be substantially evenly distributed. If the user is transporting two UUVs, the user can leave one UUV outboard, while working with the other UUV. The open water transport system permits the user to redistribute the weights of the UUV/ROV loads.

The carriage assemblies 248, 249 may couple the open water transport system to the one or more payloads either under the superstructures 231, 235 or over/above the superstructures 231, 235.

The open water transport system 200 may be modular and composed of system modules. The system modules may include sponsons 210, 215, deck plate modules 220, 225, superstructures 231, 235 and carriage assemblies 248, 249. Each system module is configured to be separable from each other said system module so that the system may be disassembled and taken apart. Likewise, each said system module may be joined to each other by attachment mechanisms such as bolts, or sliding rails, so that the system may be assembled and used to transport one or more payloads.

Figure 5A:
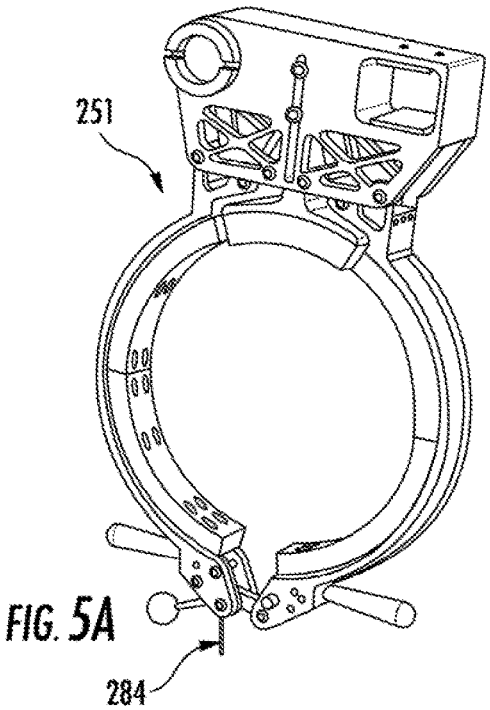
FIG. 5A illustrates the carriage assembly in a closed configuration in accordance with one embodiment of the present disclosure.
Figure 5B:
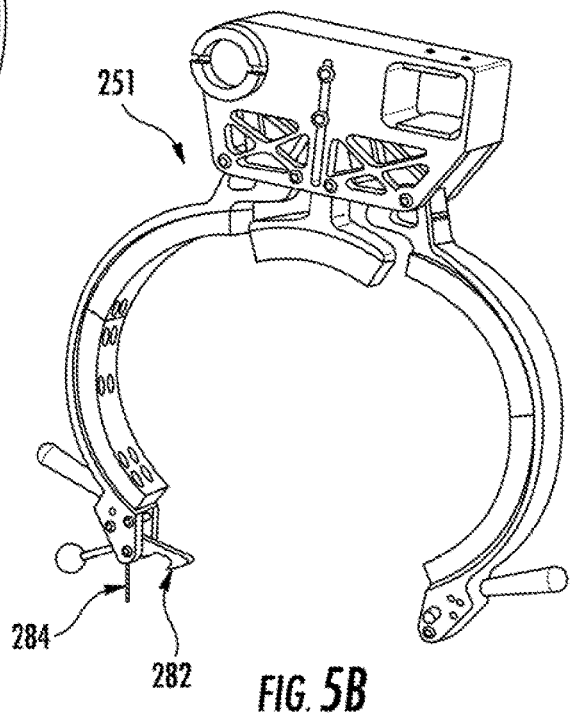
FIG. 5B illustrates the carriage assembly in a partially open configuration in accordance with one embodiment of the present disclosure.

The carriage assemblies may receive a UUV/ROV or other payload via clamp assemblies 251, 252, 255, 257. FIG. 5A illustrates a clamp assembly 251 in accordance with one embodiment of the present disclosure. When not in use, the clamp assembly 251 may remain in a closed configuration. The clamp assembly 251 may be activated substantially automatically to clamp to UUV (not shown in FIG. 5A) when the UUV/ROV makes contact with the clamp assembly 251. FIG. 5B illustrates the clamp assembly 251 in a partially open state in accordance with one embodiment of the present disclosure.

Figure 5C:
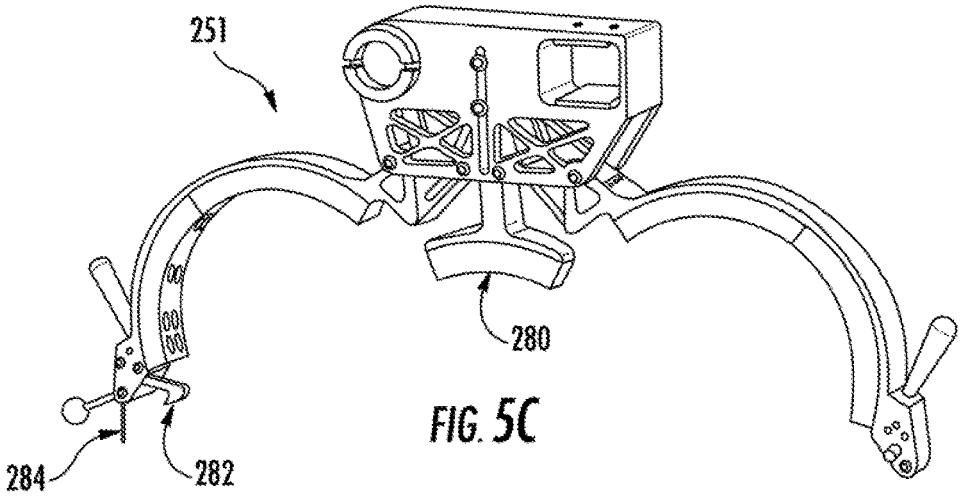
FIG. 5C illustrates the carriage assembly in a closed configuration in accordance with one embodiment of the present disclosure.

Once the carriage assembly is ready to receive a payload, it may lift the payload by way of a hoist. The payload may be, for example, a UUV/ROV (not shown in FIG. 5A). As a general matter, the clamp assembly 251 may be in a normally open state as shown in FIG. 5C. A combination of springs keeps the two halves of the clamp assembly 251 open. As a UUV/ROV is pulled up by a hoist (not shown in FIG. 5A), the UUV/ROV pushes on the half-arc 280 of clamp assembly 251, causing the clamp assembly 251 to close. When the half-arc 280 is pushed up, it overcomes the force of the internal torsion and compression springs that normally keep the clamp assembly 251 open. FIG. 5C illustrates the carriage assembly in a fully open configuration in accordance with one embodiment of the present disclosure.

There is a latch 282 on a torsion spring 284. The latch 282 moves to a closed position upon activation. The latch 282 allows the clamp assembly 251 to lock in place. Upon closing, the clamp assembly 251 may return to its configuration as in FIG. 5A.

Figure 6:
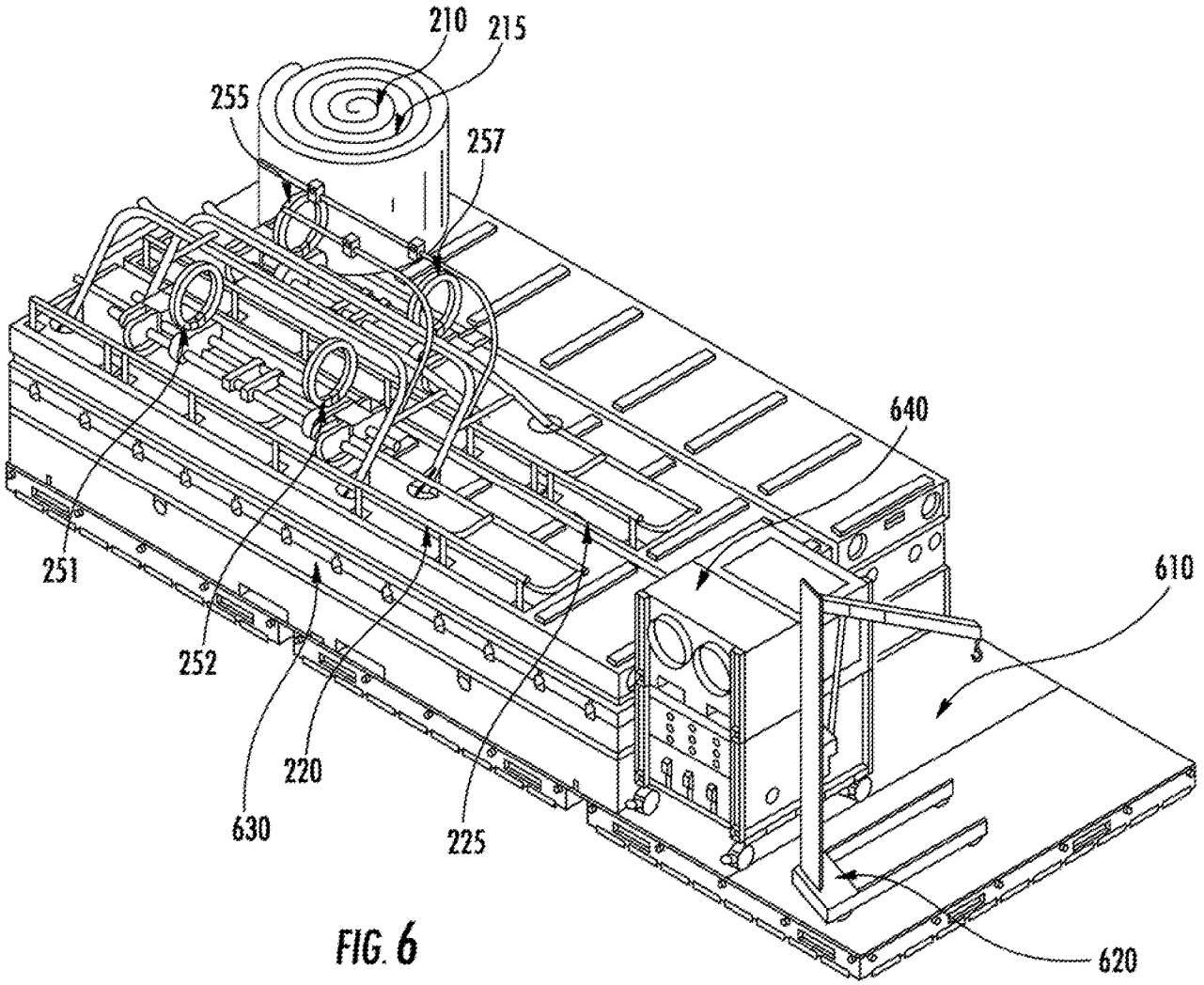
FIG. 6 illustrates the open water transport system of FIGS. 3, 4A and 4B after it has been disassembled and palletized.

FIG. 6 illustrates the open water transport system of FIGS. 3, 4A and 4B after it has been disassembled and palletized. As shown in FIG. 6, a master pallet 610 has been laid out. Master pallet 610 may be any type of pallet suitable to support the various disassembled open water transport system parts as well as any other items desired to be supported. Master pallet 610 may be, for example, a 463L-type master pallet or a pallet designed for cargo, e.g., military air cargo. Various items may have been moved onto the master pallet 610, including the crane 620 shown in FIG. 6.

The sponsons 210, 215 are shown in their deflated state and are wrapped together. The sponsons 210, 215 may have been deflated after disassembly of the OWTS.

A charging container 630 may be disposed on the pallet as well. The charging container 630 may be used to recharge the UUV/ROV.

Deck plate modules 220, 225 for the open water transport system may be disposed above the charging container 630. Clamp assemblies 251, 252, 255, 257 may be attached to superstructures 231, 235 as they were when assembled. RCU 640 is also provided. RCU 640 is an electronics box that may be used with the open water transport system 200. The cross brace (not shown in FIG. 6) and the second story structure (not shown in FIG. 6) are not visible because they were placed under the sponsons 210, 215.

The open water transport system may disassemble into smaller items that can be moved by two people or users. When a user receives the palletized shipment, the user may assemble the open water transport system and use the open water transport system for the amount of time needed. Some users may use the open water transport system for about a month. Other users may use the system for shorter or longer periods. First, the user may inflate each sponson 210, 215 and attach each sponson 210, 215 onto deck plate modules 220, 225 with bolts or other suitable detachable coupling means. Then, the user may attach the superstructures 231, 235 onto the deck plate modules 220, 225 with bolts or other suitable detachable coupling means. Then, the user may slideably attach (via a rail configuration made a part of the superstructure) the first set of clamp assemblies 251, 252 which has rollers that the superstructures 231, 235 could roll on. The last thing to go on may be the cross-brace 230. The assembly/disassembly may be in a first on/first off order. For example, the cross brace 230 may be the first thing on when the open water transport system is being assembled, and the last thing off when it is being disassembled. The size of the open water transport system in it deployed state may be 8½ feet wide, 21 feet long and 4-5 feet tall. Disassembled, the open water transport system may be about 14 feet long, 4 feet wide, and 3 feet tall if you exclude the rolled-up sponsons 210, 215.

Figure 7:
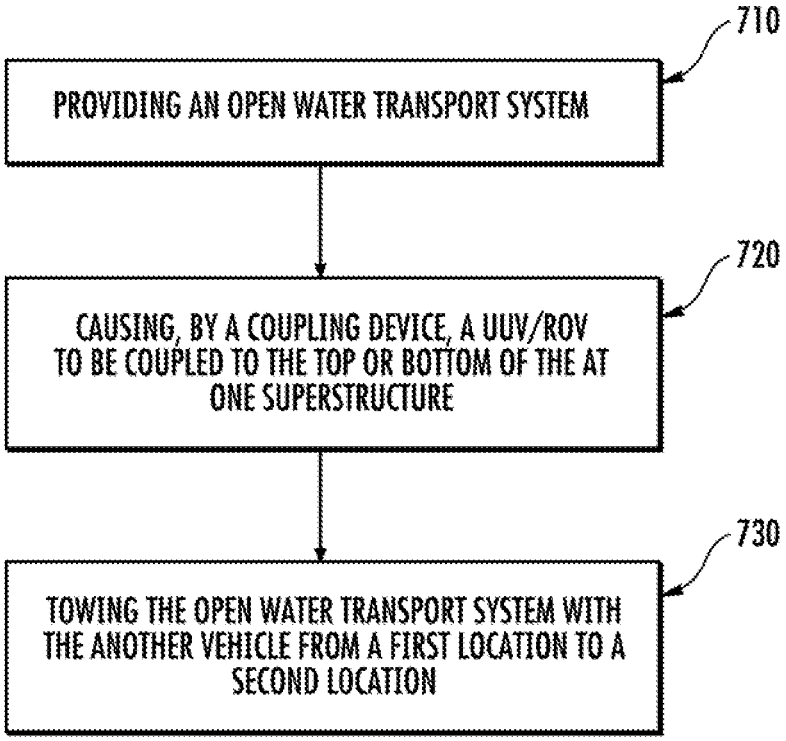
FIG. 7 is a flow chart showing the steps in a method for transporting a UUV/ROV over open water in accordance with one embodiment of the present disclosure.

Referring now to FIG. 7, illustrated are steps in a method for transporting a UUV/ROV over open water in accordance with one embodiment of the present disclosure. The method comprises, at step 710, providing an open water transport system. The open water transport system may include two sponsons, one sponson being substantially parallel to another sponson, the two sponsons being spaced apart and extending in a forward direction. The open water transport system may also include two deck plate modules, one deck plate module being substantially parallel to another deck plate module. The two deck plate modules are spaced apart and extending in the forward direction. Each deck plate module is mounted on top of each sponson. Each deck plate module is detachably coupled to each sponson.

The open water transport system that is provided may also include at least one superstructure. In some cases, two superstructures may be desired to accommodate the intended payloads. The superstructure(s) may be detachably coupled to the deck plate modules. The superstructure(s) may be configured to bear a weight of one or more payloads. The superstructure is disposed on top of the deck plate modules. Where two superstructures are present, the superstructures may include a cross brace detachably coupled to the first superstructure and the second superstructure. The superstructure(s) may be composed of metal tubing. A second story structure may be detachably mounted on top of the superstructure (s) to accommodate an additional payload.

The open water transport system that is provided at step 710 may also include at least one carriage assembly configured to slideably couple to the at least one superstructure. The at least one carriage assembly may have an adjustment mechanism configured to permit the weight of the one or more payloads to be redistributed. The open water transport system is configured to transport the one or more payloads under tow by another vehicle.

The open water transport system may be provided at step 710 in an unassembled state, and may thereafter be assembled.

At step 720, the method includes causing, by a coupling device, a UUV/ROV to be coupled to the top or bottom of the at least one superstructure. The coupling device includes a clamp assembly. Each clamp assembly is configured to clampably couple to the one or more payloads.

At step 730, the method includes towing the open water transport system with the other vehicle from a first location to a second location.

Critical system functions including UUV recovery, if electrically-powered, may have a man-powered alternative method incorporated into the launch and recovery system.

The open water transport system described herein eliminates the overly restrictive dependence on a specific deployment boat with a dedicated launch and recovery mechanism. The open water transport system can be operated (towed) from a vessel of opportunity with only the requirement of suitable tow-power and range to satisfy mission constraints. Further the system can be readily dismantled to lower-level sub-assemblies and suitably packaged for multi-mode, worldwide, shipment. This portability enhances its utility as well.

The open water transport system may be both modular and portable, giving the user the flexibility to dismantle, package, transport, and re-assemble without loss of system utility or effectiveness. When re-assembled and readied for use, the open water transport system may have a lifting interface, and a towing interface. The transport system may be stable, under a single-line tow from another vessel at sea, with one, two, or no UUVs.

The open water transport system may be capable of transiting through the open ocean environment, with two UUVs, at a range of velocities commensurate with the application for which the system is used. Additionally, the transport system may be stable, autonomously tracking the tow vessel, while under tow with either one or two UUVs as a payload. The hull profiles may act to lift the submerged portion of the hull into a hydroplaning condition as the tow velocity increases, reducing the wetted surface area and attendant hydrodynamic drag.

Using the open water transport system described herein, no swimmers may be required to be in the water for launch or recovery of a UUV or other payload. The open water transport system may safely carry two 1,000-lb. UUVs without modification. The open water transport system may be stable undertow carrying one or two UUVs.

Onboard stored energy (e.g., batteries) may be needed by the transport system to power navigation lights or communication equipment, e.g., GPS, radio if those items are present. A suitable interface may be provided for securing batteries, e.g., two 12 Volt DC marine grade batteries, 35 Amp-hours minimum each.

The foregoing description of various embodiments has been presented for purposes of illustration and description. It is not intended to be exhaustive or to limit the invention to the precise forms disclosed, and obviously many modifications and variations are possible in light of the above teaching. The example embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed as new and desired to be protected by Letters Patent of the United States is:

1. An open water transport system, comprising:

a plurality of sponsons substantially parallel to each other;

a plurality of deck plate modules each deck plate module configured to be detachably mounted on top of each sponson;

at least one superstructure detachably mounted to the deck plate modules and configured to bear a weight of at least one payload;

a carriage assembly having an adjustment mechanism configured to cause the weight of the at least one payload to be redistributed, the carriage assembly being further configured to couple the open water transport system to the at least one payload; and a clamp assembly including a half-arc that facilitates coupling such that the half-arc causes the clamp assembly to close when the clamp assembly contacts the at least one payload, wherein the contact comprises pushing the half-arc to overcome a force of internal torsion and compression springs that normally cause the clamp assembly to remain open, wherein the open water transport system is configured to be under tow by another vehicle.

2. The system of claim 1, wherein the clamp assembly is configured to engage an outer circumference of the at least one payload.

3. The system of claim 1, wherein the at least one superstructure comprises a first superstructure and a second superstructure.

4. The system of claim 1, further comprising a cross brace detachably coupled to the at least one superstructure.

5. The system of claim 1, wherein the at least one superstructure is composed of metal tubing.

6. The system of claim 1, further comprising:

a second story structure detachably mounted on top of the superstructure, wherein the second story structure is configured to bear a weight of at least one payload.

7. The system of claim 1, wherein each sponson is interchangeable with each other sponson, and each deck plate module is interchangeable with each other deck plate module.

8. The system of claim 1, wherein each sponson is inflatable.

9. A method for transporting a payload over open water, comprising the steps of:

providing an open water transport system that includes:

a plurality of sponsons substantially parallel to each other;

a plurality of deck plate modules, each deck plate module capable of being detachably coupled to each sponson;

at least one superstructure detachably coupled to the deck plate modules configured to bear a weight of one or more payloads;

a carriage assembly configured to slideably couple to the at least one superstructure to permit the weight of the one or more payloads to be redistributed; and a clamp assembly including a half-arc that facilitates coupling such that the half-arc causes the clamp assembly to close when the clamp assembly contacts the one or more payloads, wherein the contact comprises pushing the half-arc to overcome a force of internal torsion and compression springs that normally cause the clamp assembly to remain open, and towing the open water transport system with another vehicle from a first location to a second location.

10. The method of claim 9, wherein the at least one superstructure comprises a first superstructure and a second superstructure.

11. The method of claim 10, wherein the open water transport system further comprises a cross brace detachably coupled to the first superstructure and the second superstructure.

12. The method of claim 9, wherein the at least one superstructure is composed of metal tubing.

13. The method of claim 9, wherein the open water transport system further comprises:

a second story structure configured to be detachably mounted on top of the at least one superstructure.

14. An open water transport system, comprising:

a first sponson substantially parallel to a second sponson, the first and second sponsons being spaced apart and extending in a forward direction;

a first deck plate module substantially parallel to a second deck plate module, the first and second deck plate modules being spaced apart and extending in the forward direction, wherein the deck plate modules are detachably mounted on top of the sponsons;

first and second superstructures composed of metal tubing and detachably coupled to the deck plate modules;

a cross brace that connects the first superstructure to the second superstructure, wherein the cross brace and the superstructures are configured to bear a weight of one or more payloads that are attachable on top or on bottom of the superstructures; and at least one carriage assembly that includes:

a clamp assembly including a half-arc that facilitates coupling such that the half-arc causes the clamp assembly to close when the clamp assembly contacts the one or more payloads, wherein the contact comprises pushing the half-arc to overcome a force of internal torsion and compression springs that normally cause the clamp assembly to remain open, and an adjustment mechanism configured to cause the weight of the one or more payloads to be balanced, wherein the at least one carriage assembly is configured to slideably couple to the superstructures, wherein the open water transport system is configured to transport the one or more payloads and to be under tow by another vehicle.

15. The system of claim 14, further comprising:

a second story structure configured to be detachably mounted on top of the superstructures.

16. The system of claim 14, wherein each sponson is interchangeable with each other sponson, and each deck plate module is interchangeable with each other deck plate module.

17. The system of claim 14, wherein each sponson is inflatable.

* * * * *